United States Patent [19]

Iannelli

[11] 4,437,319

[45] Mar. 20, 1984

[54] BEVERAGE DISPENSING DEVICE

[75] Inventor: Frank M. Iannelli, Spartanburg, S.C.

[73] Assignee: Tannetics, Inc., Erie, Pa.

[21] Appl. No.: 497,437

[22] Filed: May 26, 1983

Related U.S. Application Data

[63] Continuation of Ser. No. 316,873, Oct. 30, 1981, abandoned.

[51] Int. Cl.[3] ..... F25C 1/00; F25D 3/00

[52] U.S. Cl. ..... 62/138; 62/201; 62/399

[58] Field of Search ..... 62/392, 399, 201, 59, 62/138; 236/78 B, 20 R, 21 B

[56] References Cited

U.S. PATENT DOCUMENTS

| | | | |
|---|---|---|---|
| 2,039,556 | 5/1936 | Ruse | 62/399 |
| 2,419,376 | 4/1947 | Shaw | 62/399 X |
| 2,470,936 | 5/1949 | Gerfo | 62/392 X |
| 2,627,369 | 2/1953 | Laurence | 62/59 X |
| 3,056,273 | 10/1962 | Cornelius | 62/396 X |
| 3,263,442 | 8/1966 | Timmersman | 62/399 X |
| 3,734,402 | 5/1973 | Morgan | 236/21 B |

*Primary Examiner*—William E. Wayner
*Attorney, Agent, or Firm*—Julian W. Dority

[57] ABSTRACT

A beverage cooling device which mounts on top of a cabinet so that a warm beverage, such as beer carried in a keg is cooled prior to flowing out of a faucet. The apparatus includes a cylindrical container having an evaporator coil positioned closely adjacent an inner wall and a beverage dispensing coil centrally positioned within the container. A space is provided between the inner wall of the container and the beverage dispensing coil so as to permit ice to build up on the wall of the container. A power-operated propellor is centrally located within the container for circulating water over the layer of ice and around the beverage dispensing coil to enhance the cooling of the beer flowing through the coil. A temperature sensor is carried in the water between the ice layer and the beverage cooling coil for controlling the operation of a compressor for maintaining the proper temperature of water in the container.

2 Claims, 2 Drawing Figures

BEVERAGE DISPENSING DEVICE

This application is a continuation of application Ser. No. 316,873 filed Oct. 30, 1981 and now abandoned.

BACKGROUND OF THE INVENTION

Heretofore, normally kegs of beer have to be refrigerated from the time they leave the brewery until they are used in order to avoid spoiling of the beer. This requires refrigerated trucks for transporting the kegs of beer from the brewery to a refrigerated storage warehouse and refrigerated trucks for distributing the kegs to the ultimate users. The cool kegs of beer are then stored in a refrigerated storage area at the establishment where they are utimately to be used, and as they are used, they must be maintained in a refrigerated cabinet. As can be seen, such is an expensive and cumbersome way of dispensing tap beer. Recently, however, breweries have begun pasteurizing beer placed in kegs and as a result the beer does not have to be refrigerated. However, the beer has to be cooled prior to being consumed.

SUMMARY OF THE INVENTION

This invention relates to an apparatus for cooling beer as it is removed from a keg and dispensed. The apparatus includes a container having a vertically extending wall with a top and bottom. An evaporator coil is carried adjacent the wall of the container and extends vertically from adjacent the bottom of the container to adjacent the top of the container. A refrigeration condensing means circulates a refrigerant through the evaporator coil. A beverage dispensing coil is centrally carried within the container and extends vertically from adjacent the bottom of the container to adjacent the top of the container. Water is provided in the container and a temperature sensor is immersed in the water between the beverage dispensing coil and the evaporator coil so as to control the operation of the refrigeration condensing means in order to maintain the water at a desired temperature. In one particular application, the temperature is maintained at approximately 33–34 degrees Farenheit.

The beverage dispensing coil has an outside diameter substantially smaller than the diameter of the container so as to provide a space between the inside wall of the container and the beverage dispensing coil. As a result, a layer of ice is permitted to build up on the inside wall of the container without touching the beverage dispensing coil.

A manually operated tap is carried adjacent the top of the container and is connected to one end of the beverage dispensing coil. The other end of the beverage dispensing coil is connected by means of a tube to the pressurized keg so that upon opening the tap, beer from the keg flows through the dispensing coil for cooling the beer prior to being dispensed through the tap. A power-operated propeller is centrally located within the dispensing coil for circulating the water within the container so as to provide an effective cooling medium for the beer flowing through the dispensing coil. It is noted that as the water is circulated, it engages the layer of ice built up on the inside wall of the container.

Accordingly, it is an important object of the present invention to provide a simple and effective apparatus for cooling beverages such as warm beer coming from a keg as it is dispensed.

Another important object of the present invention is to provide a simple and reliable device that can be readily installed on top of conventional cabinets for cooling beer as it is being dispensed.

These and other objects and advantages of the invention will become apparent upon reference to the following specification, attendant claims, and drawing.

DESCRIPTION OF A PREFERRED EMBODIMENT

Figure 1:
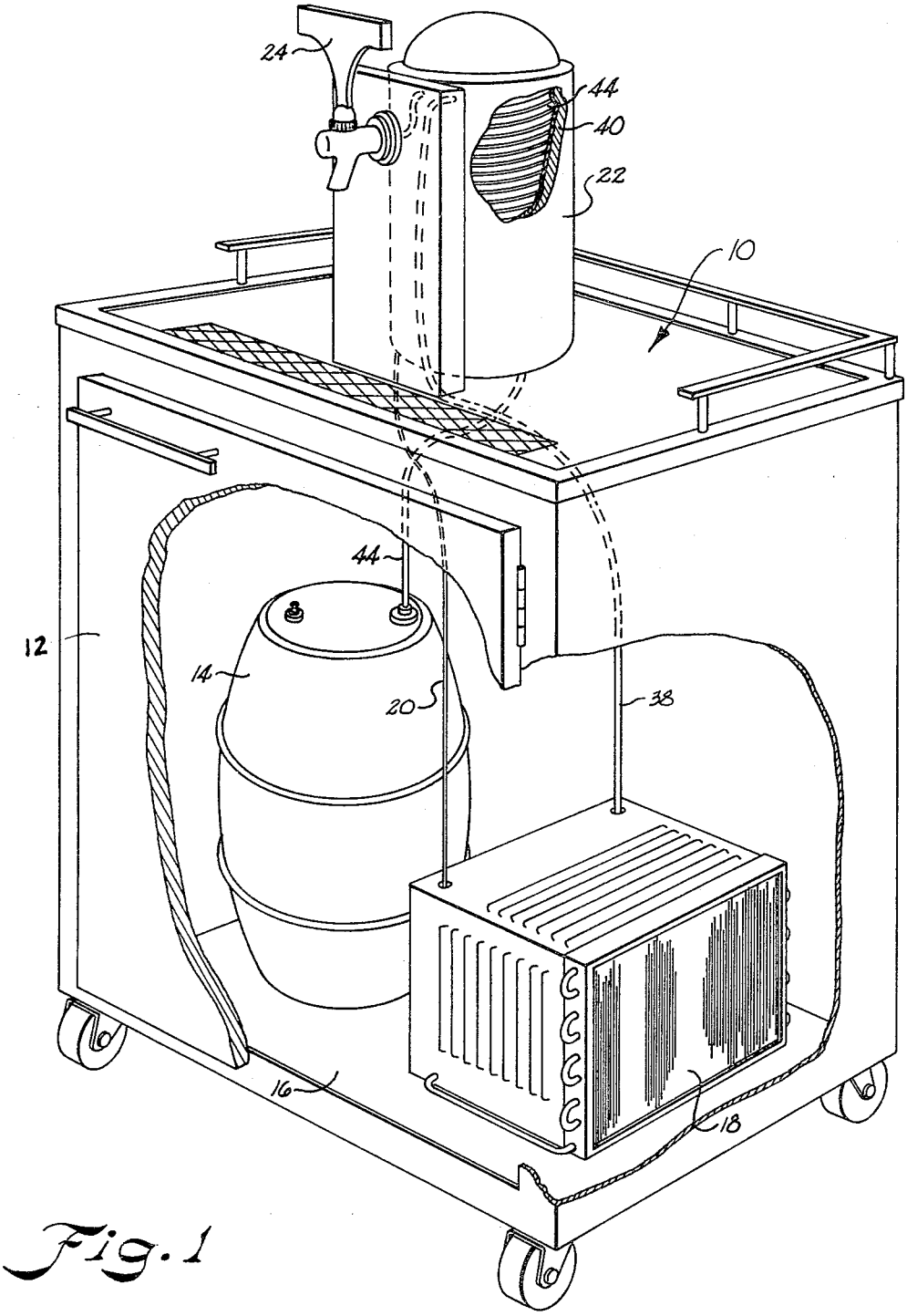
FIG. 1 is a perspective view with parts broken away showing a refrigeration system for cooling beer as the beer is dispensed from a keg.

Referring to FIG. 1 of the drawing, there is disclosed a cabinet generally designated by the reference character 10 which has a door 12 provided on the front thereof for permitting access to the interior. A keg of beer 14 is positioned within the cabinet and supported on a bottom 16. Also positioned within the cabinet is a refrigeration condensing means 18 which may be of any suitable conventional construction.

Extending outwardly from the refrigeration condensing means 18 is a capillary tube 20 through which a refrigerant flows up to a container 22. The container 22 is provided for cooling the beer as it flows from the keg 20 to a conventional on-off tap 24. The container includes a cylindrical side wall 26 that is joined by a bottom wall 28 and a top 30. The top 30 has a cylindrical opening therein for receiving a cap 32 that has a motor 34 provided therein. Extending downwardly from the motor 34 is a shaft which has a propeller blade 36 connected to the lower end thereof.

An evaporator coil 38 is carried within the inside wall 26 of the container and extends vertically upwardly from adjacent the bottom of the container to the top. The bottom of the evaporator coil 38 is connected directly to the capillary tube 20 extending from the compressor 18. The other end of the evaporator coil 38 is connected to the compressor 18.

Insulation 40 is provided between the inner wall 26 of the container and an exterior wall 42.

The interior of the container is filled with water to a level closely adjacent the top of the container directly above the upper coil of the evaporator coil 38.

A beverage dispensing coil 42 is centrally carried within the container and extends vertically from adjacent the bottom of the container to adjacent the top of the container. The lower end of the beverage dispensing coil is connected by means of a tube 44 to the pressurized keg 14. The upper end of the beverage dispensing coil is, in turn, connected to the tap 24. It is noted that the propellor 36 is centrally located within the beverage dispensing coil. The beverage dispensing coil 42 has an outside diameter which is less than the diameter of the container so as to provide a space between the evaporator coils 38 and the beverage dispensing coils 42. This space should be sufficient to allow a buildup of ice as shown by reference character 44 around the evaporator coil. This buildup of ice generally extends from the bottom of the container closely adjacent the top.

A temperature sensing probe 46 extends down into the space between the ice buildup 44 and the beverage dispensing coil. The probe should not touch either the ice or the beverage dispensing coil and should be immersed in the water carried within the container. The temperature sensing probe 46 is connected by electrical wires and conventional circuitry to the compressor for controlling the operation of the compressor so as to maintain the temperature of the water within the container at a predetermined temperature.

Figure 2:
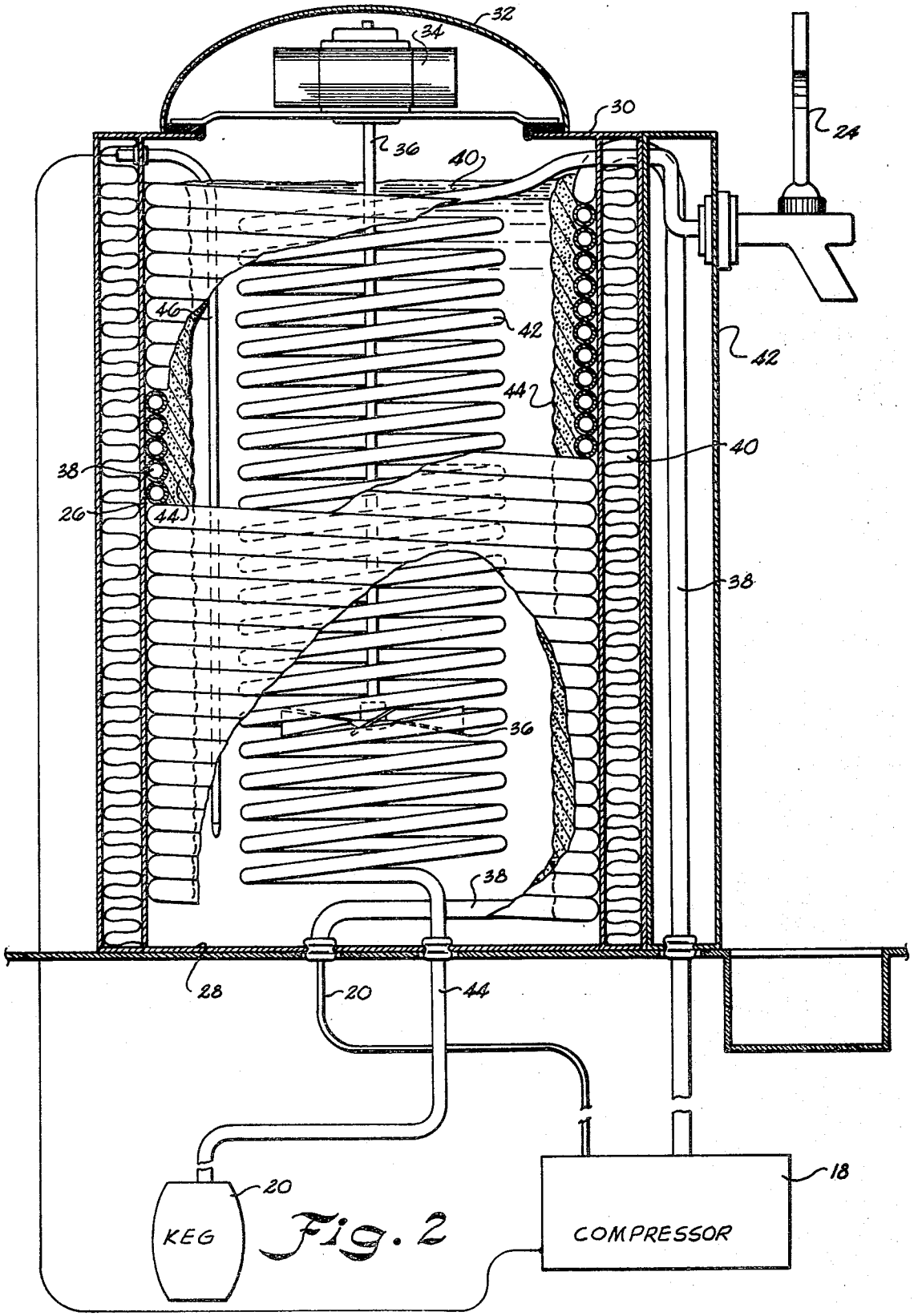
FIG. 2 is a sectional view of the refrigeration apparatus.

The sensing probe 46 extends downwardly from adjacent the top of the container to adjacent the bottom thereof as shown in FIG. 2. The vertically extending elongated temperature sensor 46 permits the thickness of the ice bank to build up substantially for handling peak load use of the system while ensuring that the ice bank 44 does not touch the beverage dispensing coil 42.

In one particular apparatus, the inside diameter of the container is $6\frac{3}{4}''$ and the inside diameter of the evaporator coil is 6". The outside diameter of the beverage dispensing cil is 4". The height of the container is $11\frac{1}{4}''$. There are 22 turns in the beverage dispensing coil. The ice buildup from the interior wall of the container is about $\frac{3}{4}''$. Of course, all of the above dimensions could vary depending on the particular structure desired and capacity of the structure.

In operation, once the keg 20 is connected up to the tube 44, when the tap 24 is opened, the warm beer from the keg 20 flows up through the cooling tubes 42 and is cooled to approximately 34 degrees prior to flowing out of the tap 24. As a result of the propeller blade 36 rotating, the water within the container is circulated bringing it in contact with the layer of ice buildup on the side of the container and the dispensing coil 42. It is important that the buildup of ice does not touch the cooling tube 42 since it would freeze beer carried in the dispensing coil. The temperature sensor 46 ensures that the water between the layer of ice 44 and the dispensing coil 42 remains above freezing by selectively turning on and off the compressor 18.

While a preferred embodiment of the invention has been shown, such description is for illustrative purposes only, and it is to be understood that changes and variations may be made without departing from the spirit or scope of the following claims.

What is claimed is:

1. A refrigeration system for cooling a beverage as said beverage is drawn from a keg comprising:

a container having a vertically extending wall and a top and bottom;

an evaporator coil carried adjacent the wall of said container extending vertically from adjacent the bottom of said container to adjacent the top of said container;

refrigeration condensing means circulating a refrigerant through said evaporator coil cooling said container;

a beverage dispensing coil centrally carried within said container extending vertically from adjacent the bottom of said container to adjacent the top of said container;

water carried within said container;

a temperature sensor immersed in said water and being operably connected to said refrigeration condensing means for maintaining said water at a predetermined temperature;

said beverage dispensing coil having a predetermined outside diameter so as to provide a space between said inside wall of said container and said beverage dispensing coil for allowing a bank of ice to build up on said inside wall;

said elongated temperature sensor extending vertically downwardly in a space between said ice bank and said beverage dispensing coil from adjacent the top of said container to adjacent the bottom thereof for activating said refrigeration condensing means responsive to predetermined changes in the temperature of said water;

said elongated vertically extending temperature sensor permitting the thickness of said ice bank to build up substantially for handling peak load use of said system while ensuring that said ice bank does not touch said beverage dispensing coil;

a manually operated tap carried adjacent the top of said container connected to one end of said beverage dispensing coil;

tubular means connecting said keg to said other end of said beverage dispensing coil so that upon opening said tap, beverage from said keg flows through said dispensing coil for being cooled prior to flowing out said top, and a power driven propeller means carried within said beverage dispensing coil for moving said water carried in said container in a circular motion for wiping said ice bank for melting said ice bank for cooling said water and said beverage dispensing coil, said flow path being substantially unimpeded between the output of said propellor and said ice bank.

2. The refrigeration system as set forth in claim 1 further comprising:

said evaporator coil being positioned inside said container adjacent the inside wall so that said ice buildup is permitted to encapsulate said cooling coil.

* * * * *